US005769268A

United States Patent [19]

Kuzma et al.

[11] Patent Number: 5,769,268

[45] Date of Patent: Jun. 23, 1998

[54] FLANGE SHAPE FOR ATTACHING A CLOSURE TO A FILLABLE CONTAINER

[75] Inventors: Gene J. Kuzma, Columbus; Douglas W. Weaver, Troy, both of Ohio

[73] Assignee: G. K. Packaging, Inc., Columbus, Ohio

[21] Appl. No.: 743,918

[22] Filed: Nov. 5, 1996

Related U.S. Application Data

[63] Continuation of Ser. No. 276,977, Jul. 19, 1994, abandoned.

[51] Int. Cl.[6] ..... B65D 41/16

[52] U.S. Cl. ..... 220/780; 215/217

[58] Field of Search ..... 215/317, 318; 220/780, 782, 783, 796

[56] References Cited

U.S. PATENT DOCUMENTS

| | | | |
|---|---|---|---|
| 2,403,511 | 7/1946 | Enkur | 220/306 X |
| 2,926,812 | 3/1960 | Wilcox | 220/780 |
| 2,953,272 | 9/1960 | Mumford et al. | 220/306 X |
| 3,421,653 | 1/1969 | Whaley | 220/780 |
| 3,642,167 | 2/1972 | Kinney | 220/780 |
| 3,901,401 | 8/1975 | Lynn et al. | 215/317 |
| 3,904,063 | 9/1975 | Hauser | 215/318 |
| 3,907,146 | 9/1975 | Fields | 215/317 |
| 4,098,421 | 7/1978 | Foster | 220/306 |
| 4,209,107 | 6/1980 | Crisci | 220/306 |
| 4,488,688 | 12/1984 | Flaska et al. | 222/548 |
| 4,700,860 | 10/1987 | Li | 215/317 |
| 4,709,832 | 12/1987 | Mantyla | 220/780 |
| 5,368,178 | 11/1994 | Towns et al. | 215/317 |

FOREIGN PATENT DOCUMENTS

| | | | |
|---|---|---|---|
| 247126 | 5/1966 | Austria | 215/217 |

*Primary Examiner*—Allan N. Shoap
*Assistant Examiner*—Robin A. Hylton
*Attorney, Agent, or Firm*—John L. Gray; Kegler, Brown, Hill & Ritter

[57] ABSTRACT

A flange shape which permits a minimum amount of force to be used in causing the closure to engage the container thus enabling a minimum amount of material to be used in the manufacture of the container while maximizing the amount of force necessary to disengage the closure after it has been attached to the top of the container.

3 Claims, 3 Drawing Sheets

FLANGE SHAPE FOR ATTACHING A CLOSURE TO A FILLABLE CONTAINER

This application is a continuation of application Ser. No. 08/276,977 filed Jul. 19, 1994, now abandoned.

BACKGROUND OF THE INVENTION

Containers, such as containers for baby powders, often have a snap-on closure as shown in U.S. Pat. No. 4,488,688, Flaska, et al. The closure in such a container is forced down over a circular flange extending around the opening in the container. If the required force needed in assembling the closure onto the container over the flange is excessive, the container will collapse. Alternatively, it is necessary to construct the container with sufficient material so that it will resist such collapse.

SUMMARY OF THE INVENTION

Applicant has developed a flange shape which permits a minimum amount of force to be used in causing the closure to engage the container thus enabling a minimum amount of material to be used in the manufacture of the container while maximizing the amount of force necessary to disengage the closure after it has been attached to the top of the container.

It is therefore an object of this invention to provide a flange shape surrounding the opening of the container which will enable the closure to be securely attached to the said container using a minimum amount of downward application force.

It is a further object of this invention to provide such a flange shape which may be readily incorporated into the manufacture of the container.

It is a still further object of this invention to produce such a container that will have a minimum amount of material contained therein to provide structural strength.

It is a still further object of this invention to provide such a construction that will operate over a maximum range of closure and container relative diameters.

It is a still further object of this invention to provide a flange shape so that a maximum amount of force is necessary to disengage the closure after it has been attached to the top of the container for a given difference in diameters.

These, together with other objects and advantages of the invention will become more readily apparent to those skilled in the art when the following general statements and descriptions are read in the light of the appended drawings.

DETAILED DESCRIPTION OF THE INVENTION

Figure 1:
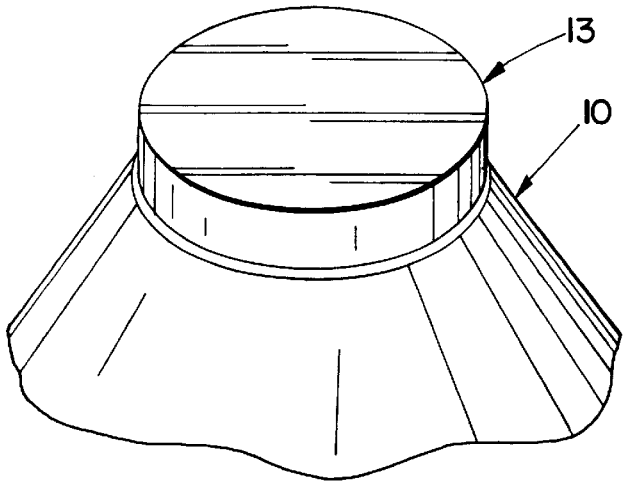
FIG. 1 shows a perspective view of a typical container with the closure attached thereon.
Figure 2:
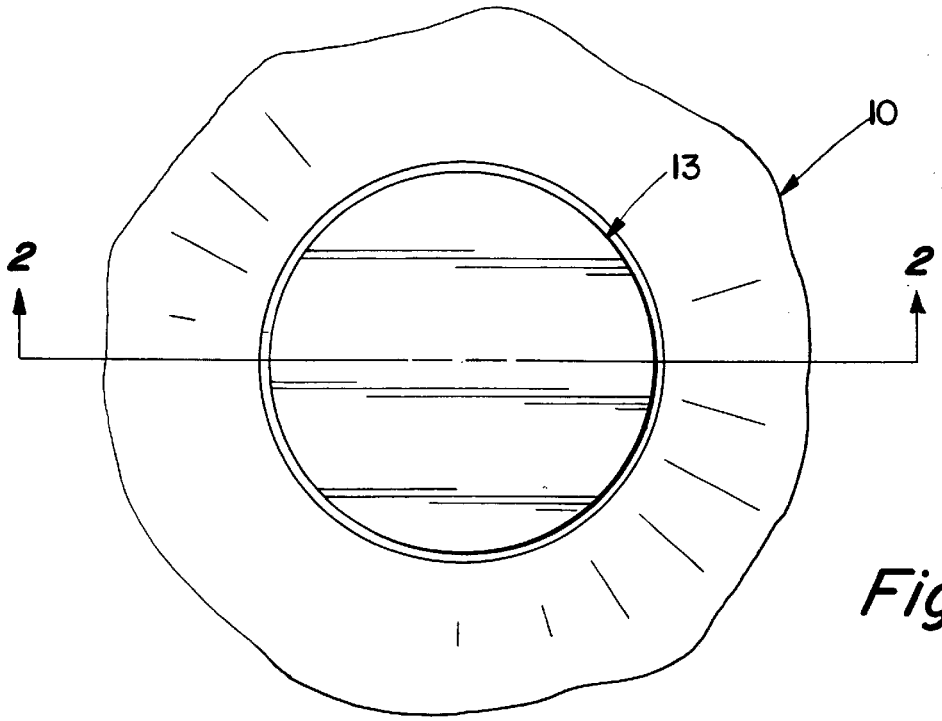
FIG. 2 is a top view of the same container and closure.
Figure 3:
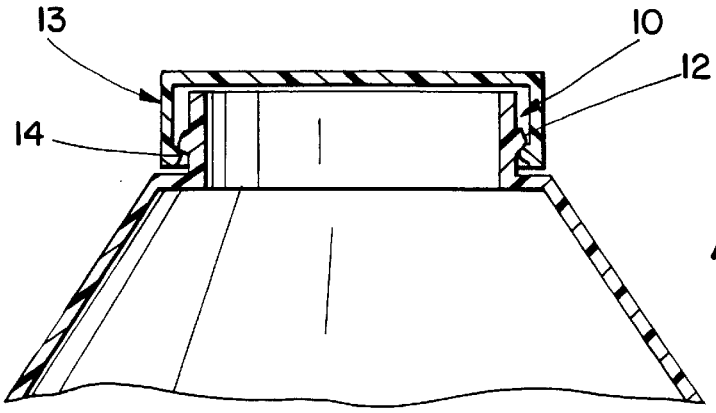
FIG. 3 is a vertical cross section of FIG. 2 on the plane 2—2.
Figure 4:
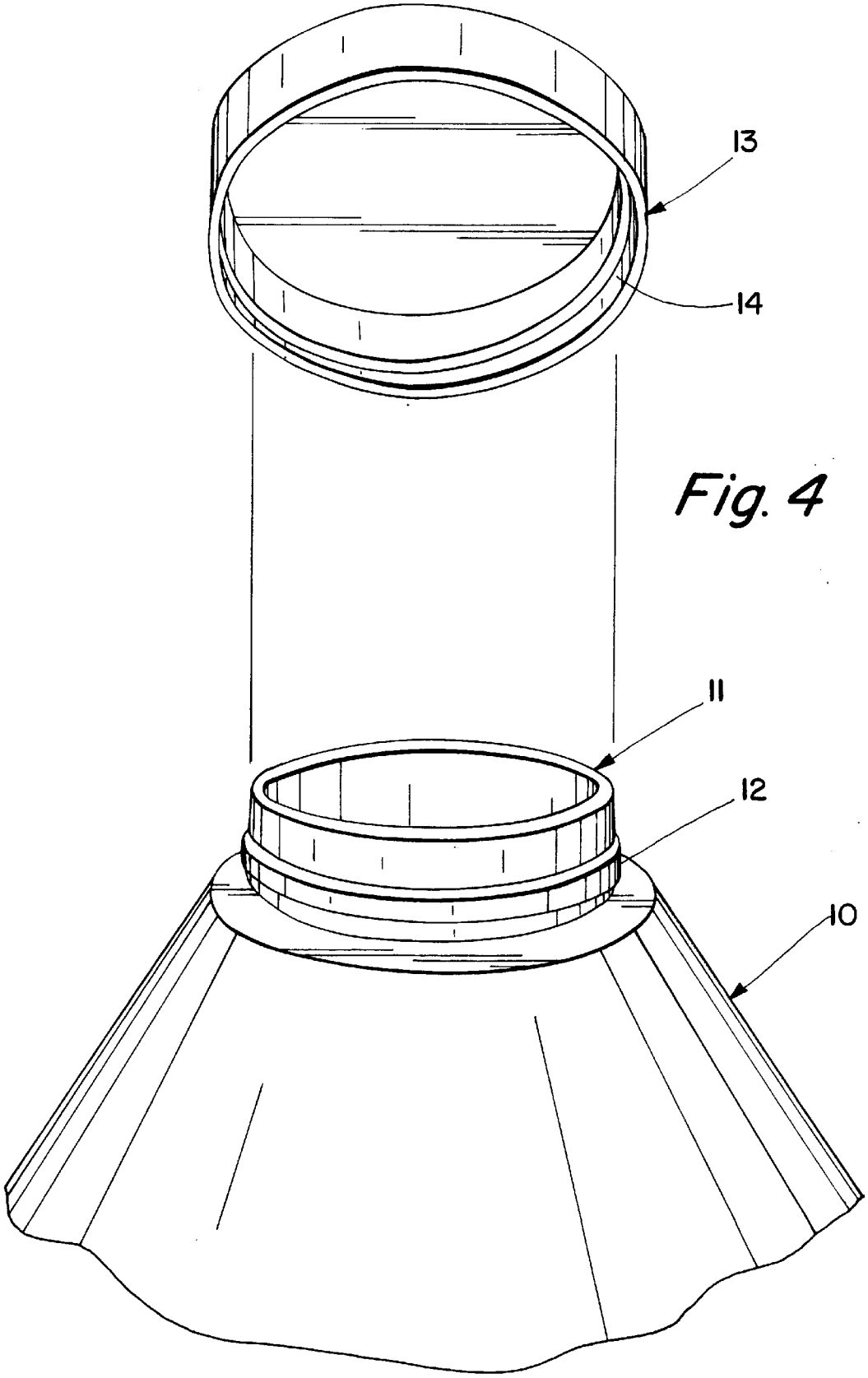
FIG. 4 is a typical container with the closure in disassembled relationship.

Referring now more particularly to FIGS. 1, 2, 3, and 4, the container 10 is shown with a circular opening 11 and a flange shown, generally at 12. The closure 13 is provided with an internal rind 14 which has greater elasticity than the flange 12. The internal diameter of the internal ring 14 is less than the external largest diameter of flange 12. When the closure 13 is forced down over the outside of the opening 11 the initial contact between the ring 13 and the flange 12 is best shown in section in FIG. 5.

Figure 5:
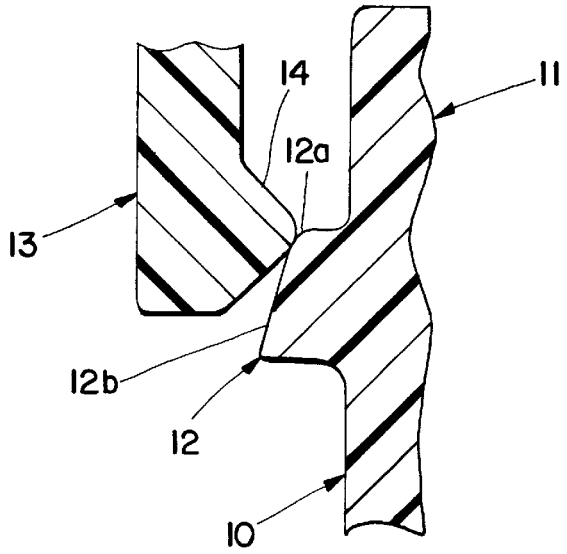
FIG. 5 is an enlarged vertical cross-sectional view of a portion of FIG. 3 showing the container flange being initially engaged by the closure member.
Figure 6:
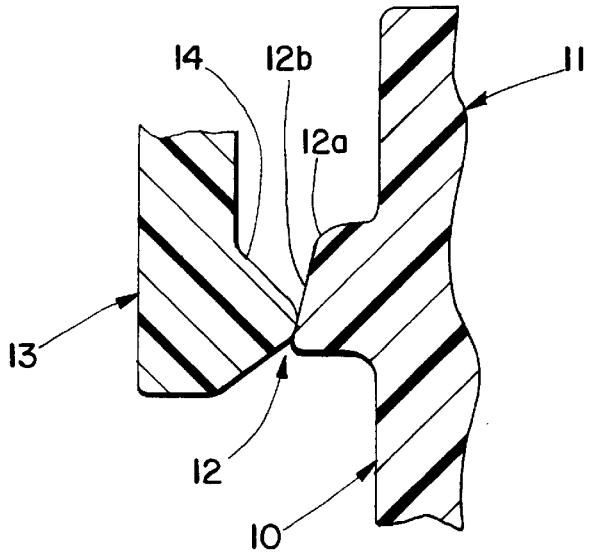
FIG. 6 is an enlarged vertical cross-sectional view of the same elements shown in FIG. 5 with the closure member having been expanded almost to its maximum diameter.

The upper surface shape 12*a* of flange 12 as shown in cross section in FIG. 5 (is chosen) has a rapidly expanding diameter in a downward direction so as to cause the internal ring 14 to be stretched as rapidly as possible by a desired minimum downward application load. The angle of the contact surface of flange 12 will change to a steeper angle at 12*b* essentially flat in cross-section as the internal ring 14 moves downwardly over the flange 12. This is best shown in FIG. 6.

Figure 7:
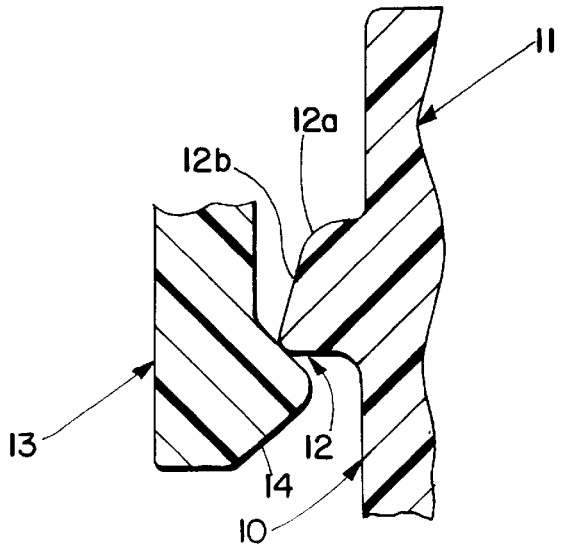
FIG. 7 is an enlarged vertical cross-sectional view of the same elements as shown in FIG. 6 showing the closure member fully engaged on the flange of the container.

Thereafter by utilizing approximately the same minimum downward application load the internal ring 14 will move past the lowest portion of the flange 12 and be engaged thereby, thus permanently seating the closure 13 on the top of the container 10 as shown in FIG. 7.

EXAMPLE 1

Flanges were reconstructed with steeper portions having angles with the vertical of 10°, 15°, 20°, and 25°. In each instance the upper end of the flange had a 0.030 inch fillet radius that was tangent to the horizontal position of the flange and tangent to the vertical portion of the flange. The loads that were required to effect the engagement of the same closure with each of these variations in flange shape for a given difference in diameter are set forth below.

| Angles with Vertical or Lower Portion of Flange | Load/Pounds |
|---|---|
| 10° | 19.1 |
| 15° | 20.3 |
| 20° | 25.5 |
| 25° | 29.0 |

This compares very favorably with a load of 47.3 pounds utilizing the current industry standard flange configuration recommended by the closure manufacturer, Owens-Illinois Corporation.

Unexpectedly at an angle of 12 1/20° the load dropped further to 17.2 pounds. However, while that is an optimum angle, any angle below 25° provides a significant decrease in load in applying the closure to the top of the container when compared with the current practice in the industry.

While the data set forth in the above example relate to specific angles as is shown in FIGS. 5, 6, and 7, the contact surface shape can be a gentle curve rather than a straight line.

While this invention has been described in its preferred embodiment, it is to be appreciated that variations therefrom may be made without departing from the true scope and spirit of the invention.

What is claimed:

1. A container having a circular opening therein and provided with a flange encircling said circular opening of said container and comprising:

a circular member attachable to the opening of said container, said circular member being provided with an internal ring extending around the interior of said circular member, said internal ring being made from a material which is more elastic than the material from which said flange is made, said flange retaining said circular member on said container when said circular member is forced downwardly over said flange by stretching said internal ring over said flange, said flange being characterized in cross section by a varying slope on the external portion thereof which has at the upper section thereof which first engages said internal ring when said circular member is forced downwardly over said flange, a rapidly expanding diameter of said flange as said circular member moves downwardly over said flange, whereby said internal ring will be stretched rapidly by a desired minimum downward application load, said slope of said flange thereafter gradually changing to a steeper portion essentially flat in cross section, and having a more slowly expanding diameter as said circular member is forced downwardly thereover, said internal ring being further characterized in cross section by having an inwardly extending portion which is semi-circular and of a size and shape so as to be the only portion of said circular member engaging said flange when seated below said flange and the only portion of said circular member engaging said flange on that portion of said flange having a varying slope on the external portion thereof during downward application and prior to being seated below said flange, said internal ring being of a diameter so that when centered over said circular opening of said container said inwardly extending portion of said internal ring will only engage the portion of said flange having a varying slope on the external portion thereof during downward application, such that said minimum downward application load is not substantially altered, whereby said internal ring may be continued to be stretched using the same approximate minimum downward application load until said internal ring is forced over that portion of said flange at its maximum diameter where it terminates in a minimal radius which forms the contact surface when said internal ring has been forced over said flange.

2. The invention of claim 1 wherein said steeper portion of said flange has an angle relative to the vertical of from 0° to 25°.

3. The invention of claim 2 wherein said steeper portion of said flange extends over more than the lower half of the vertical height of the flange.

* * * * *